United States Patent [19]

Ricke

[11] Patent Number: 4,538,340

[45] Date of Patent: Sep. 3, 1985

[54] METHOD OF CLAMPING A SINK BOWL TO A COUNTER TOP

[76] Inventor: James Ricke, 38 W. 594 Hilltop Dr., St. Charles, Ill. 60174

[21] Appl. No.: 509,424

[22] Filed: Jun. 30, 1983

[51] Int. Cl.[3] ..... B23P 19/00

[52] U.S. Cl. ..... 29/526 R; 4/634; 52/584; 269/249

[58] Field of Search ..... 29/526 R, 469; 52/584; 4/634; 269/249

[56] References Cited

U.S. PATENT DOCUMENTS

| | | | |
|---|---|---|---|
| 2,817,097 | 12/1957 | Henley, Jr. | 4/634 |
| 2,883,677 | 4/1959 | Geen | 4/634 |
| 2,973,524 | 3/1961 | Daniels | 4/634 |
| 3,014,476 | 12/1961 | Barnett | 4/634 X |
| 3,034,141 | 5/1962 | Lyon | 4/634 |
| 3,060,454 | 10/1962 | Ament | 4/634 |
| 3,751,791 | 8/1973 | Horwitz et al. | 29/469 |
| 3,990,135 | 11/1976 | De Angelis | 29/526 R X |
| 4,057,892 | 11/1977 | White | 29/526 R |

*Primary Examiner*—Charlie T. Moon
*Attorney, Agent, or Firm*—Hauke and Patalidis

[57] ABSTRACT

A clamp in the form of a generally L-shaped bracket or clip made preferably of a single stamping of spring steel or like material and provided with a threaded member, threading through the base of the bracket or clip. The top of the bracket or clip is provided with an angularly inwardly projecting integral portion terminating in a slightly downwardly bent flange forming a hook. The clamp is used principally for holding a sink bowl, or the like, in an opening in a counter top by cooperating with a generally L-shaped angle-iron strip welded to the underneath of the sink bowl flange. For removably holding the sink bowl in the opening in the counter top, the hook end of the clamp bracket body is engaged behind an inwardly bent flange portion of the angle-iron strip and the threaded member is tightened against the lower surface of the counter top proximate the opening. When the threaded member is tightened, the angle-iron strip and the sink bowl flange are drawn toward the top surface of the counter top while, simultaneously and due to the geometry of the clamp clip having its hook end non-aligned with the end of the threaded member and to the engagement of the back of the clamp clip with the inner surface of the angle-iron strip, fastening of the threaded member is amplified by leverage, thus greatly increasing the pressure holding the sink flange against the top surface of the counter top.

1 Claim, 3 Drawing Figures

FIG. 1
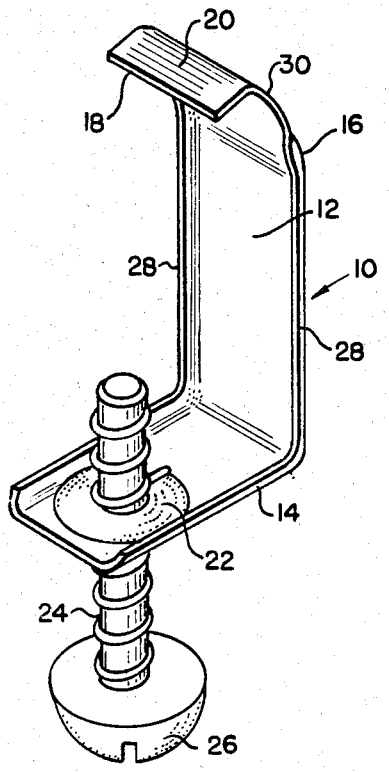
FIG. 3
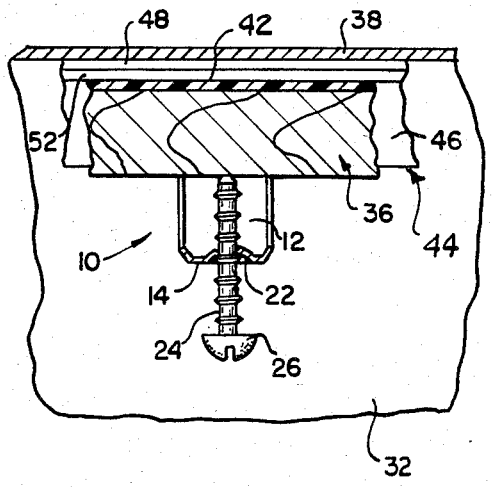
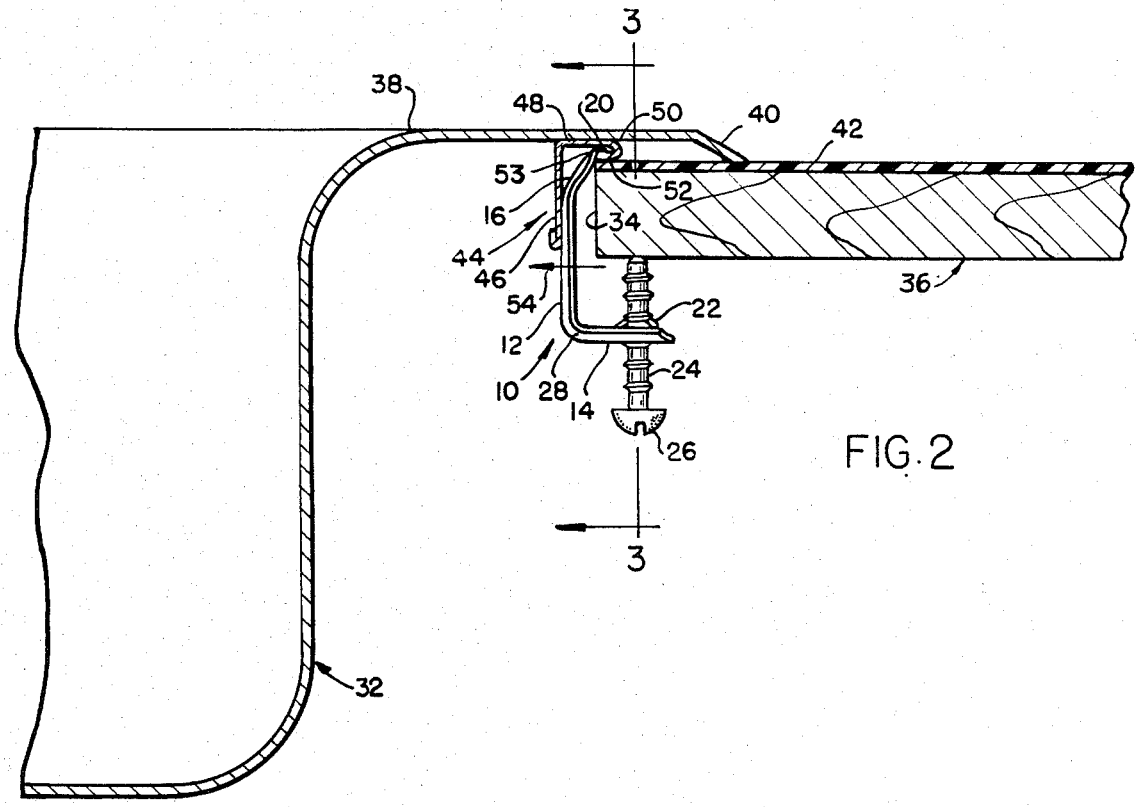
FIG. 2

METHOD OF CLAMPING A SINK BOWL TO A COUNTER TOP

BACKGROUND OF THE INVENTION

The present invention relates to a method and to a clam clip for holding an article such as a sink bowl and the like in a counter top opening.

Sink bowls are conventionally held in an opening in a counter top by way of mounting brackets spot-welded, for example, to the lower surface of the bowl flange overlapping the opening, the brackets being provided with apertures through which are passed fasteners, such as wood screws driven into the counter top material at the edge of the opening, or through the bottom surface of the counter top proximate the edge of the opening. The mounting brackets may be in the form of separate bracket elements welded at convenient locations, or in the form of a molding strip, the brackets being L-shaped in some installation and U-shaped in other installations. Other methods of securing a sink bowl in a counter top opening have been devised which avoid driving fasteners, such as wood screws, into the material of the counter top. Such alternate methods generally use clamping arrangements formed integral with the mounting brackets, including threaded members passed through appropriate threaded apertures in the bracket engaging the surface of the counter top, generally the lower surface proximate the edge of the opening, and holding the sink bowl in position by pulling the bowl flange edge in engagement with the top surface of the counter top proximate the opening.

Conventional clamping arrangements for holding sink bowls in a counter top opening, however, present the disadvantage that they are limited in the amount of pressure or clamping force exerted on the surfaces of the counter top proximate the opening, and further may become loose due to thermal expansion and concentration of the metallic elements and contraction and expansion of the counter top material due to change of humidity in the atmosphere and aging.

SUMMARY

The present invention remedies the inconvenience of the prior art by providing a clamp member or clip having a top end portion lockingly engaging in a groove formed by an inwardly bent edge portion of a generally L-shaped molding or angle-iron strip fastened to the lower surface of a sink bowl flange, such as by spot-welding, the clamp clip having a back portion in engagement with the inner surface of the molding or angle-iron strip portion disposed substantially perpendicular to the lower surface of the bowl flange. The clamp clip is further provided with a base portion through which is driven a threaded member, the end of which is adapted to engage the lower surface of the counter top proximate the opening. The surface of the counter top engaged by the end of the threaded member is outwardly eccentric relative to the top surface of the counter top engaged by the inwardly turned edge flange of the angle-iron strip, such that when the threaded member is tightened the clamp clip is rocked or swung in the direction that increase the pressure exerted by the back of the clamp clip on the inner surface of the angle-iron strip portion perpendicular to the lower surface of the sink bowl flange, thus greatly amplifiying the clamping force drawing the bowl flange towards and in engagement with the top surface of the counter top. Furthermore, as both the clamping member or clip body and the co-operating mounting angle-iron strip are made of somewhat resilient metallic material, a constant biasing action is exerted on the cooperating elements which prevent any play from occuring through aging, as is the case when using rigid fastening members.

The clamping arrangement of the present invention therefore also provides a new method for mounting an article, such as a sink bowl, in an opening in a support member, such as a counter top.

A better understanding of the objects and advantages of the present invention will be had by those skilled in the art when the following description of the best mode contemplated for practicing the invention is read in conjunction with the accompanying drawing, wherein:

BRIEF DESCRIPTION OF THE DRAWING

FIG. 1 is a perspective view of a clamp clip according to the present invention;

FIG. 2 is a partial sectional view through a counter top showing the clamping arrangement of the present invention used for holding a sink bowl in an opening in the counter top; and FIG. 3 is a partial sectional view from line 3—3 of FIG. 2.

DETAILED DESCRIPTION OF THE PREFERRED EMBODIMENT

Referring to the drawing, and more particularly to FIGS. 1 and 2, a clamping member or clip 10, according to the present invention, comprises a body 12 stamped and formed from sheet material such as thin spring steel and the like. The clamp clip body 12 is generally L-shaped when seen in side elevation, FIG. 2, with an integral base portion 14 bent substantially at right angle to the plane of the body portion 12. The other end of the clip body 12 is also bent over, as shown at 16, at an obtuse angle, in the range of 110° to 140° for example, such that the top edge 18 of the clip body 12 projects a short distance over the base portion 14. Proximate the top edge 18 of the clip body 12, the clip body 12 is further bent such as to form a hooking flange 20 having a lower surface at least parallel to the surface of the base portion 14, but preferably at a slight angle of convergence therewith. The base portion 14 is provided with an aperture whose edge is helicoidally shaped such as to threadably accept a threaded member 24. The bent over flange, or hook, portion 20 of the clamp clip body 12 is disposed such that the axis of the threaded member 24 is eccentrically outwardly positioned relative to the end flange or hook portion 20. In other words, an orthogonal projection of the edge 18 of the hooking flange 20 falls on the base portion 14 between the common axis of the aperture 22 and threaded member 24 and the main portion of the clip body 12.

The threaded member 24 is illustrated as being provided with a slotted enlarged head 26, although it will be readily apparent that a slotted or unslotted knurled knob, or a wing head, a T-head, a hexagonal head, or any other type of well-known screw or bolt head may be substituted for the slotted head 26. The clamp clip body 12 is further formed with a pair of lateral flanges 28 providing increased rigidity to the clip body. In the example illustrated, the lateral flanges 28 are inwardly directed and are each provided with a small cut-out portion 30 proximate the top edge 18 of the clip body 12, such as not to interfere with the hooking end edge flange portion 20 when the lower surface thereof is engaged with a co-operating element, as will be hereinafter explained.

FIGS. 2–3 illustrate an example of use of the clamp clip 10 of the invention for mounting and holding a sink bowl 32 in an opening 34 formed in a counter top 36. The sink bowl 32 is provided with an integral flange 38 having an outer perimeter larger than the opening 34 such as to overlap the opening, the flange 38 terminating at its edge by way of a downwardly projecting rim 40. Consequently, the lower surface of the sink bowl flange 38 overlapping the portion of the top surface 42 of the counter top 36 proximate the opening 34 is disposed substantially parallel and spaced away from the top surface 42 of the counter top 36. A molding or angle-iron strip 44, which has two integral portions 46 and 48 disposed substantially at right angle to each other, is fastened to the bottom of the sink bowl flange 38, by way of the back surface of the angle-iron strip portion 48 being permanently attached to the lower surface of the sink bowl flange 38 by spot-welding, for example. The portion 48, or base portion, of the angle-iron strip 44 is provided with a downwardly directed bent portion 50 in turn provided with an inwardly bent flange portion 52 forming and inner groove 53.

The clamp clip 10 is disposed in the space between the edge surface of the opening 34 and the inner surface of the portion 46 of the angle-iron strip 44 which is substantially perpendicular to the surface of the sink bowl flange 38. The hook end portion 20 of the clamp clip 10 is engaged with the upper surface of the flange 52, thus projecting into the groove 53. The back of the body portion 12 of the clamp clip 10 is normally engaged with the inner surface of the portion 46 of the angle-iron strip 44. When the threaded member 24 is tightened such that its free end engages the lower surface of the counter top 36, the angle-iron strip 44 and the sink bowl flange 38 are drawn toward the top surface 42 of the counter top 36 until the lower surface of the angle-iron edge flange 52 and the edge of the sink bowl flange rim 40 engage the top surface 42 of the counter top 36. Simultaneously, because the axis of the threaded member 24 is located eccentrically, to the right as seen at FIG. 2, of the surface area engaged by the lower surface of the flange portion 52 of the angle-iron strip molding 44, there is caused a torque in the direction of the arrow 54 which in turn causes a rocking or swinging force, also in the direction of the arrow 54, to be exerted on the clamp clip 10. Consequently, the back surface of the clamp clip body 12 exert a force on the inner surface of the portion 46 of the angle-iron strip 44, as a function of the amount of pressure caused by the tightening of the threaded member 24, with the result that the pressure exerted by the edge of the sink bowl flange rim 40 and by the lower surface of the flange portion 52 of the angle-iron strip 44 is greatly amplified by leverage relative to the pressure exerted by the threaded member 24. In addition, because of the inherent elasticity of the clamp clip body 12 and of the angle-iron strip 44, a biasing action is exerted on the rim 38 constantly and elastically urging it towards the top surface 42 of the counter top 36, compensating for any non-elastic deformation, contraction and expansion of the co-operating elements.

It will be appreciated that a plurality of clamp clips 10 are used for holding an article such as a sink bowl in an opening in a counter top, and that the clamp clips of the invention permit easy disassembly of the assembled elements and have many practical applications in addition to that here described and illustrated for illustrative purpose.

Having thus described the present invention by way of an example of structural embodiment for practicing the invention, modification whereof will be apparent to those skilled in the art, what is claimed is:

1. A method of mounting a flanged sink bowl in an opening in a counter top comprising attaching an angle-iron molding strip to the lower surface of said sink bowl flange, the portion of said molding attached to said lower surface having an inwardly directed marginal groove, placing said sink bowl in said opening in the counter top with flange and said portion of the strip attached thereto in engagement with the surface of said counter top proximate the opening and the other portion of said molding disposed within said opening, and holding said sink bowl in said opening by means of at least one clamp clip having a hooking end engaging said groove and a threaded fastener with an end engaged with the bottom surface of said counter top proximate said opening and arranged such that upon tightening of said threaded member said clamp clip engages and urges said other portion of said strip in a direction springingly urging the edge of said first portion and said sink bowl flange towards the top surface of said counter top.

* * * * *

UNITED STATES PATENT AND TRADEMARK OFFICE

CERTIFICATE OF CORRECTION

PATENT NO. : 4,538,340

DATED : September 3, 1985

INVENTOR(S) : James Ricke

It is certified that error appears in the above-identified patent and that said Letters Patent are hereby corrected as shown below:

Col. 1, line 7 (our page 2, line 31), change "clam" to --clamp--;

Col. 1, line 63 (our page 3, line 24), change "increase" to --increases--.

Col. 3, line 26 (our page 7, line 7), change "and" to --an--.

Signed and Sealed this

*Tenth* Day of *December 1985*

*Attest:*

DONALD J. QUIGG

*Attesting Officer* *Commissioner of Patents and Trademarks*